US006832498B2

(12) United States Patent
Belden, Jr. et al.

(10) Patent No.: US 6,832,498 B2
(45) Date of Patent: Dec. 21, 2004

(54) SECURITY STORAGE CONTAINER

(75) Inventors: Dennis D. Belden, Jr., Canton, OH (US); Nicholas M. Sedon, Massillon, OH (US)

(73) Assignee: Alpha Security Products, Inc., Charlotte, NC (US)

( * ) Notice: Subject to any disclaimer, the term of this patent is extended or adjusted under 35 U.S.C. 154(b) by 0 days.

(21) Appl. No.: 09/897,159

(22) Filed: Jun. 29, 2001

(65) Prior Publication Data

US 2002/0000111 A1 Jan. 3, 2002

Related U.S. Application Data

(60) Provisional application No. 60/215,586, filed on Jun. 30, 2000.

(51) Int. Cl.[7] ..... E05B 73/00

(52) U.S. Cl. ..... 70/57.1; 70/63; 70/276; 206/1.5; 206/308.2; 206/387.11

(58) Field of Search ..... 70/276, 57.1, 58, 70/63, 413; 206/1.5, 308.2, 387.11

(56) References Cited

U.S. PATENT DOCUMENTS

| | | | | |
|---|---|---|---|---|
| 1,293,324 A | | 2/1919 | Bukowski | |
| 3,933,240 A | | 1/1976 | Humble | 206/1.5 |
| 3,958,125 A | | 5/1976 | Zechmair et al. | 292/162 X |
| 4,174,034 A | * | 11/1979 | Hoo | 206/1.5 |
| 4,567,983 A | | 2/1986 | Morris | 206/1.5 X |
| 4,627,531 A | | 12/1986 | Clemens | 206/309 |
| 4,664,261 A | | 5/1987 | Frodelius | 206/387 |
| 4,678,080 A | | 7/1987 | Nelson | 206/387 |
| 4,805,769 A | | 2/1989 | Soltis et al. | 206/309 |
| 4,819,797 A | | 4/1989 | Holmgren | 206/309 |
| 4,834,238 A | | 5/1989 | Hehn et al. | 206/387 |
| 5,039,982 A | | 8/1991 | Bruhwiler | 340/572 |

FOREIGN PATENT DOCUMENTS

| | | |
|---|---|---|
| DE | 17 97 278 B2 | 8/1971 |
| DE | 31 35 795 A1 | 3/1983 |
| DE | G 84 36 936.1 | 12/1984 |
| DE | 35 13 606 A1 | 10/1986 |
| DE | 36 45 040 C2 | 10/1986 |
| DE | 35 27 843 A1 | 2/1987 |
| DE | 36 02 695 A1 | 8/1987 |
| DE | 37 28 113 A1 | 3/1989 |
| DE | G 91 06 228.4 | 9/1991 |
| DE | 295 07 538 U1 | 8/1995 |
| EP | 0 139 164 | 5/1985 |
| EP | 0 141 113 A1 | 5/1985 |
| EP | 0 141 937 A1 | 5/1985 |
| EP | 0 198 434 A2 | 10/1986 |
| EP | 0 508 201 A2 | 10/1992 |
| EP | 0 616 103 A1 | 9/1994 |
| EP | 0 355 011 B1 | 11/1994 |
| EP | 0 366 452 B1 | 12/1994 |
| FR | 2 678 907 A1 | 1/1993 |
| WO | WO 94/09234 | 4/1994 |
| WO | WO 97/16615 | 5/1997 |
| WO | WO 97/31171 | 8/1997 |
| WO | WO 98/17883 | 4/1998 |
| WO | WO 98/36143 | 8/1998 |
| WO | WO 00/75469 A1 | 12/2000 |
| WO | WO 01/41146 A1 | 6/2001 |

(List continued on next page.)

*Primary Examiner*—Lloyd A. Gall
(74) *Attorney, Agent, or Firm*—Sand & Sebolt

(57) ABSTRACT

The invention generally provides a security storage container for items of recorded media. The device automatically closes and locks when the item of recorded media is inserted into the security storage container. A locking mechanism having dual locking fingers is used to hold the device in the locked configuration. The security storage container may be configured to allow compact discs and DVD jewel boxes and other storage containers to be loaded in a "spine-out" configuration while fully displaying the front cover of the storage container.

15 Claims, 15 Drawing Sheets

U.S. PATENT DOCUMENTS

| | | | | | |
|---|---|---|---|---|---|
| 5,147,034 | A | | 9/1992 | Broadhead et al. | 206/1.5 |
| 5,209,086 | A | | 5/1993 | Bruhwiler | 70/57.1 |
| 5,215,188 | A | | 6/1993 | Wittman | 206/1.5 |
| 5,215,189 | A | * | 6/1993 | Weisburn et al. | 206/1.5 |
| 5,289,914 | A | | 3/1994 | Holmgren | 206/1.5 |
| 5,297,672 | A | | 3/1994 | MacTavish | 206/1.5 |
| 5,305,873 | A | | 4/1994 | Joyce | 206/1.5 |
| 5,375,712 | A | | 12/1994 | Weisburn | 206/387 |
| 5,468,031 | A | | 11/1995 | Holmgren | 292/81 |
| 5,524,752 | A | | 6/1996 | Mazzucchelli | 206/308.2 |
| 5,588,315 | A | | 12/1996 | Holmgren | 70/57.1 |
| 5,598,728 | A | | 2/1997 | Lax | 70/276 |
| 5,680,782 | A | | 10/1997 | Komatsu et al. | 70/57.1 |
| 5,718,332 | A | | 2/1998 | Tachibana | 206/308.2 |
| 5,768,922 | A | * | 6/1998 | Lax | 70/276 |
| 5,769,218 | A | * | 6/1998 | Yabe | 206/308.2 |
| 5,779,038 | A | | 7/1998 | Herr et al. | 206/308.2 |
| 5,779,039 | A | * | 7/1998 | Ambrus | 206/308.2 |
| 5,782,350 | A | | 7/1998 | Weisburn et al. | 206/308.2 |
| 5,802,890 | A | | 9/1998 | Espada-Velasco | 70/57.1 |
| 5,850,752 | A | * | 12/1998 | Lax | 70/276 |
| 5,882,052 | A | * | 3/1999 | Whitehead | 292/80 |
| 5,901,840 | A | * | 5/1999 | Nakasuji | 206/1.5 |
| 6,082,156 | A | * | 7/2000 | Bin | 70/57.1 |
| 6,126,001 | A | * | 10/2000 | McGill | 206/308.2 |
| 6,155,087 | A | * | 12/2000 | Necchi | 70/57.1 |
| 6,202,454 | B1 | * | 3/2001 | Nakasuji | 70/57.1 |
| 6,374,648 | B1 | * | 4/2002 | Mitsuyama | 70/57.1 |

* cited by examiner

SECURITY STORAGE CONTAINER

CROSS REFERENCE TO RELATED APPLICATION

This application claims priority from U.S. Provisional Application Ser. No. 60/215,586 filed Jun. 30, 2000; the disclosures of which are incorporated herein by reference.

BACKGROUND OF THE INVENTION

1. Technical Field

The present invention generally relates to anti-theft security devices for recorded media and, more particularly, to an anti-theft security storage container that fits around the item of recorded media and includes a internal slide having a locking tab that locks the item of recorded media in the container. Specifically, the present invention relates to an anti-theft security storage container having an internal slide that automatically moves to the closed and locked position when the item of recorded media is inserted into the container and automatically moves out of the way of the item of recorded media when the device is unlocked and being opened.

2. Background Information

Retail establishments must display items of recorded media such as CDs, DVDs, VHS tapes, cassette tapes, and video game cartridges in security devices that carry electronic article security (EAS) tags. The security devices prevent shoplifters from removing the EAS tags from the recorded media and stealing the recorded media. Many different devices are known in the art to lock EAS tags to items of recorded media. In general, the art desires that the devices be as small as possible so that shelf space is not occupied by the security container. The art also desires that the security containers are easy to load and unload so that automated equipment may be used to load the devices and so that sales clerks will not be hampered in removing the media for sale. Another problem in the art is that sharp or abrupt ledges in the security devices can catch and tear the thin plastic layer that surrounds jewel boxes and other items of recorded media. The art thus desires a security storage container that can be quickly loaded with automated equipment while protecting the thin plastic layer surrounding the item of recorded media.

Another problem in the art is that some types of security storage containers allow a shoplifter to access the end opening of a typical jewel box or DVD storage container. Shoplifters have learned that they can cut the plastic wrapping around the storage container and pry open the end opening and remove a CD or DVD from the storage container without needing to break the security device. Although some prior art security devices allow the retail store owners to load the items of recorded media in a "spine-out" configuration that prevents access to the storage containers, some retail establishments find this configuration undesirable because the front cover of the item of recorded media is then hidden behind the main wall of the security storage container that typically holds the EAS tag. The art thus desires a security storage container configuration that will prevent access to the end opening of the container while allowing the front surface of the storage container to be fully displayed without interference from other parts of the security container.

Another problem in the art of security storage containers is that the UPC symbols on the backs of the items of recorded media can be hidden or obscured by angled edges when the item of recorded media is disposed in the security storage container. The art desires a security storage container configuration that will not block access to the UPC code and that will not distort the scanability of the UPC code.

SUMMARY OF THE INVENTION

The invention generally provides a security storage container for items of recorded media. The device automatically closes and locks when the item of recorded media is inserted into the security storage container. The invention may be loaded and locked with automated equipment.

In one embodiment, the invention provides a locking mechanism having dual locking fingers that cannot be easily defeated by a shoplifter.

In another embodiment of the invention, the security storage container includes a relatively large, uninterrupted rear surface that allows product identification and information labels to be scanned by scanning devices without interference from the security storage device.

Another embodiment of the invention provides a security storage container that allows compact discs and DVD jewel boxes and other storage containers to be loaded in a "spine-out" configuration while fully displaying the front cover of the storage container.

The invention also provides a security storage container that has a smooth entrance that protects the thin plastic layer around the storage container when the storage container is being loaded into the device.

The invention also provides a security storage container that is relatively small compared to the item of recorded media so that the security storage container does not occupy a large amount of shelf space. The invention also provides a security storage container that nests together with other security storage containers to minimize storage and shipping space.

BRIEF DESCRIPTION OF THE DRAWINGS

The preferred embodiment of the invention, illustrative of the best mode in which applicant contemplated applying the principles of the invention, is set forth in the following description and is shown in the drawings and is particularly and distinctly pointed out and set forth in the appended claims.

Similar numbers refer to similar parts throughout the specification.

DESCRIPTION OF THE PREFERRED EMBODIMENTS

Figure 1:
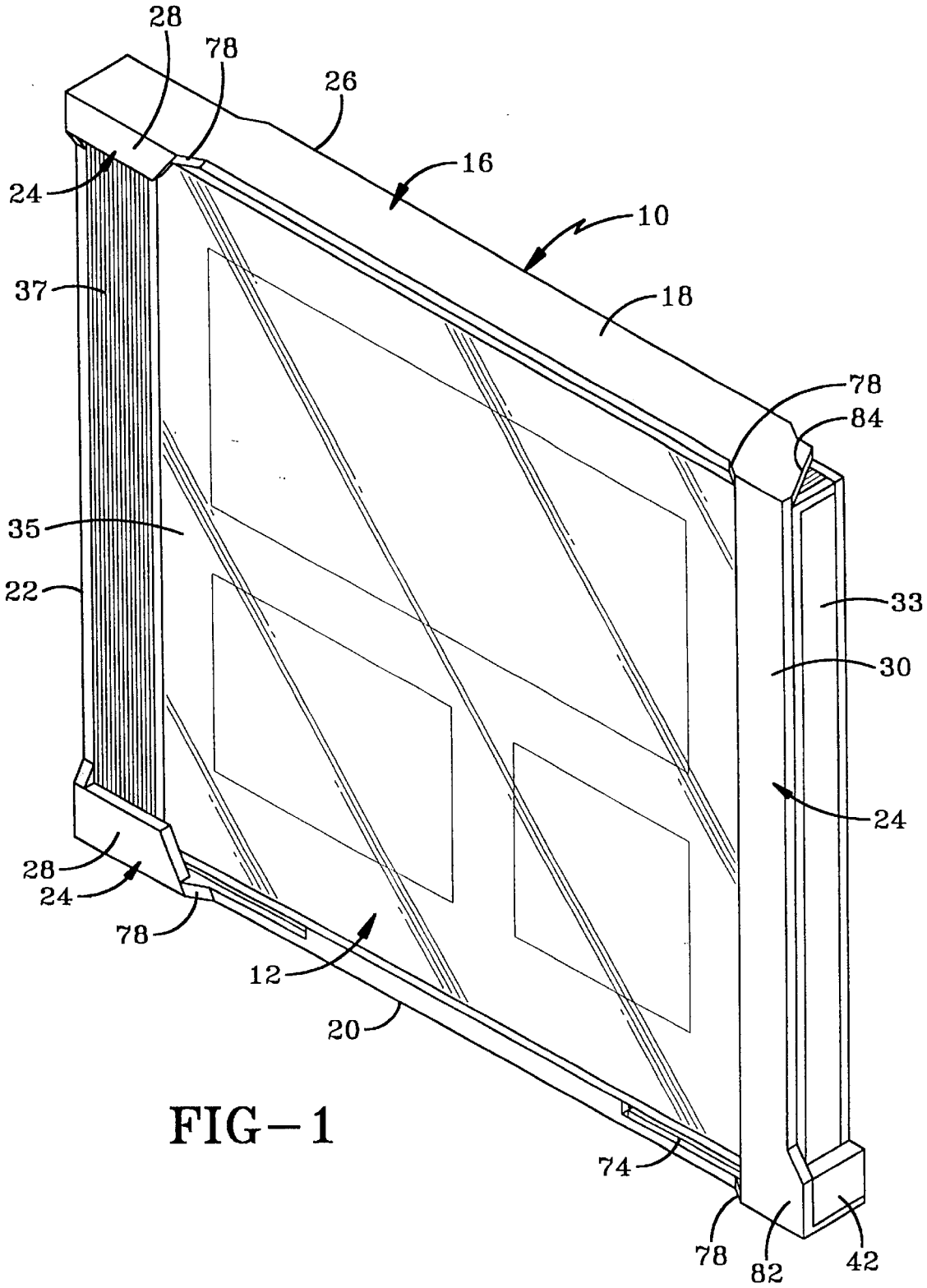
FIG. 1 is a perspective view of the security storage container of the present invention holding an item of recorded media in the form of a CD jewel box in the locked position.

The first embodiment of the security storage container or keeper of the present invention is indicated generally by the numeral 10 in the accompanying drawings. Security storage container 10 is designed to lock around an item of recorded media 12 or a storage container 12 for an item of recorded media as depicted in the drawings. Once locked around item of recorded media 12, security storage container 10 may not be removed from item 12 without breaking container 10 or using a specially designed key 14 (FIGS. 17–20). In accordance with the objectives of the present invention, security storage container 10 automatically closes and locks when item 12 is inserted into container 10. In accordance with other objectives and advantages of the invention, security storage container 10 allows item 12 to be easily removed from container 10 when key 14 is used to unlock the device.

Security storage container 10 includes a frame 16 designed to fit around item 12. In the drawings, item 12 is depicted as a CD jewel box. Container 10 may be used to lock items of recorded media 12 other than CD jewel boxes. For instance, frame 16 may be configured to hold DVD storage containers, video cassette storage containers, cassette tape storage containers, or video game cartridge storage containers. The CD jewel box and corresponding frame 16 are provided as an exemplary embodiment and do not limit the scope of the invention.

Frame 16 generally includes a top wall 18, a bottom wall 20, a rear wall 22, a front wall 24, and a back wall 26. Back wall 26 preferably includes an inset portion 25 that is defined by a ledge 27. Inset portion 25 provides space for an EAS tag 90.

Figure 23:
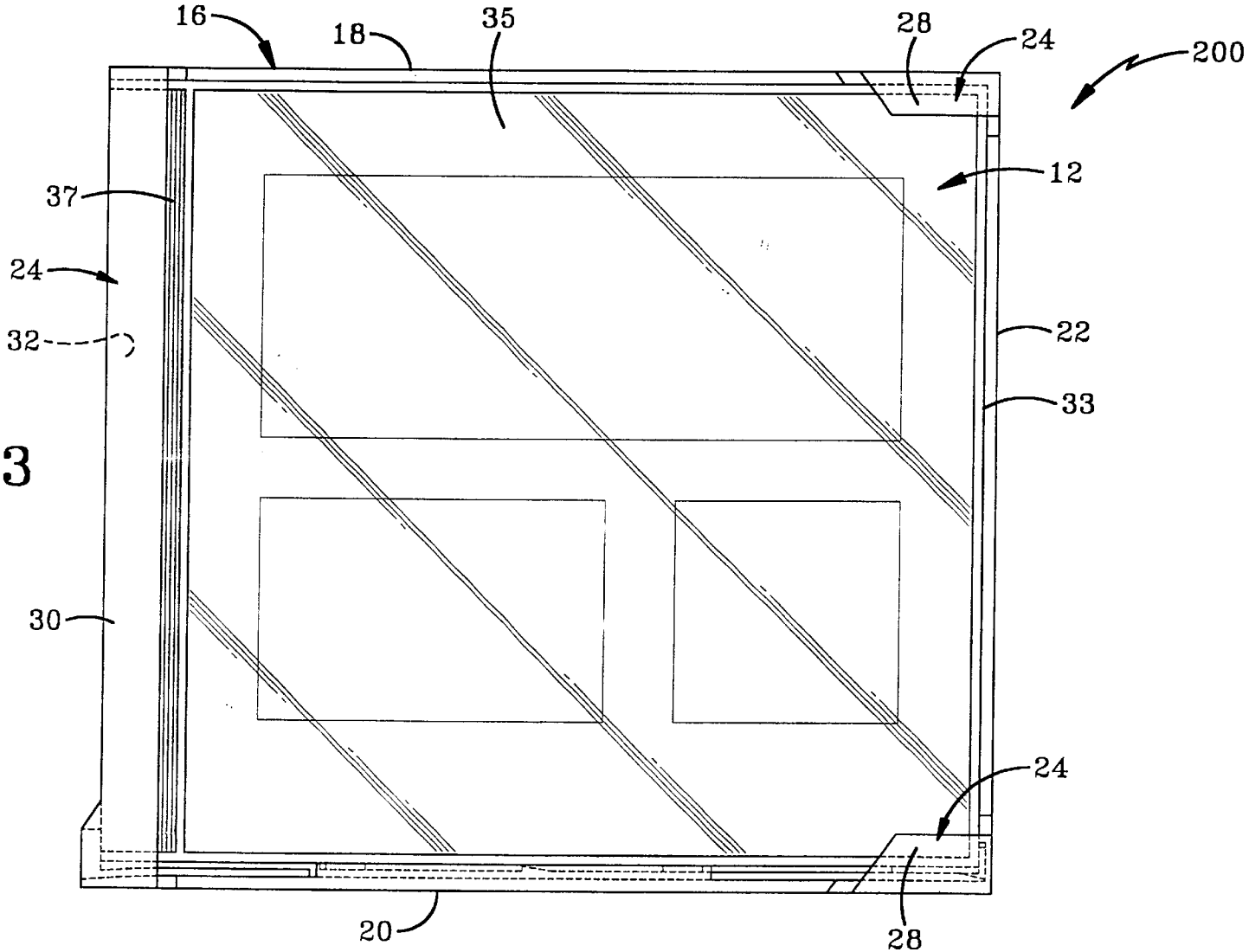
FIG. 23 is a front view of a first alternative embodiment of the security storage container of the present invention holding an item of recorded media in the form of a CD jewel box in the locked position.
Figure 24:
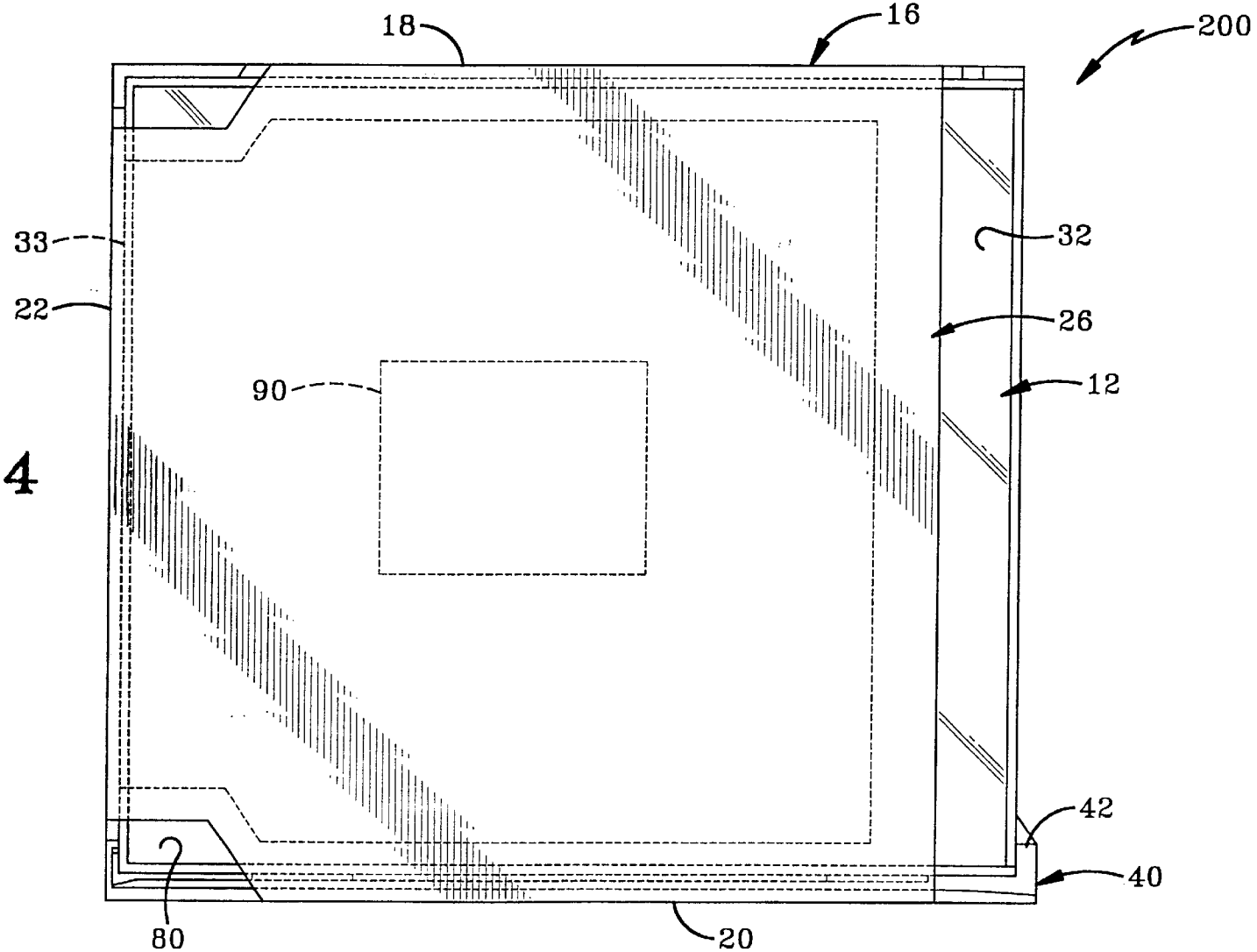
FIG. 24 is a rear view of the device in FIG. 23.

Front wall 24 preferably includes three spaced apart elements that allow the front of the item of recorded media to be readily viewed through security storage container 10 to allow the consumer to easily view and read the graphics on item 12. Front wall 24 is disposed to the left of the access opening 32 so that the open end 33 (FIG. 1) of item 12 is accessible through access opening 32 when item 12 is locked in security storage container 10. End opening 33 refers to the end of item 12 that may be opened to remove the recorded media from the storage container. When the front 35 of the item of recorded media is disposed in the large opening through front wall 24, the hinge 37 of item 12 is disposed against back wall 22. This configuration is referred to as the "spine-in" configuration. This configuration was discussed in the Background of the Invention section above and allows the shoplifter access to end opening 33 to potentially remove the item of recorded media from storage container 12 without breaking security storage container 10. An alternative configuration as depicted in FIGS. 23 and 24 and is discussed in more detail below.

Front wall 24 includes a pair of corner flanges 28 and a front flange 30. The upper corner flange 28 extends between top wall 18 and rear wall 22. The lower corner flange 28 extends between bottom wall 20 and rear wall 22. Front flange 30 extends between top wall 18 and bottom wall 20. Flanges 28 and 30 extend over a sufficient portion of item 12 to prevent item 12 from being removed from security storage container 10 through the large opening of front wall 24.

Figure 2:
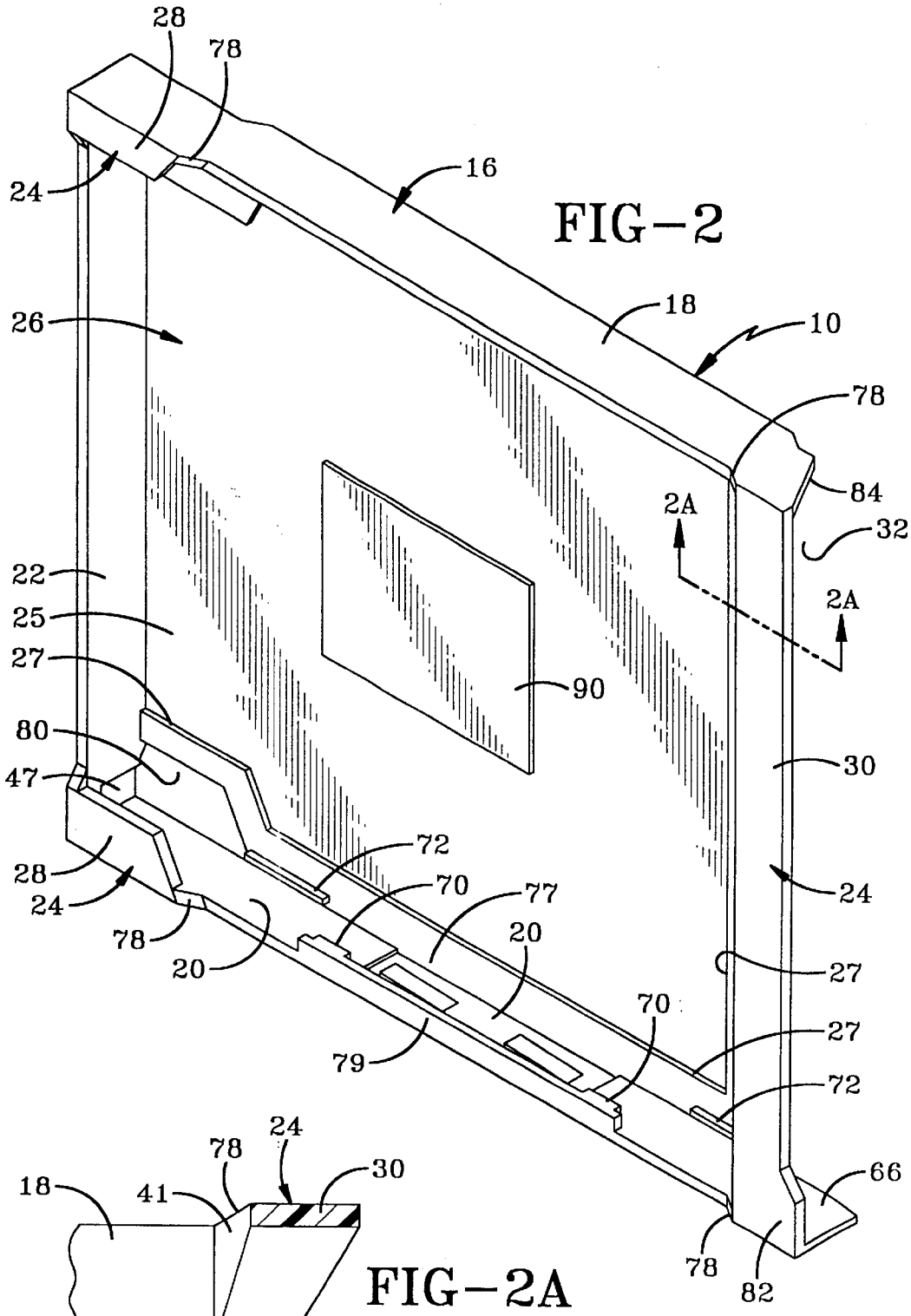
FIG. 2 is a perspective view of the frame of the security storage container with the slide removed.
Figure 2A:
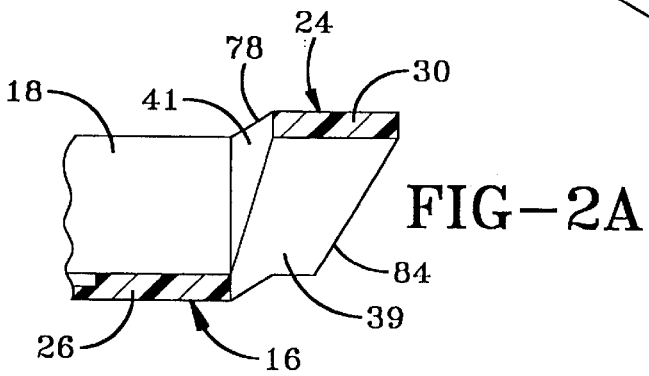
FIG. 2A is a view taken along line 2A—2A of FIG. 2.
Figure 3:
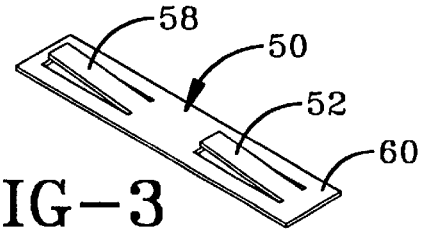
FIG. 3 is a perspective view of the locking mechanism.

Access opening 32 (FIG. 2) allows item 12 to be inserted into and removed from security storage container 10. Access opening 32 is defined by front flange 30, bottom wall 20, back wall 26, and top wall 18. Access opening 32 is preferably just large enough to receive item 12 and a slide 40 that moves longitudinally along bottom wall 20. The snug size of access opening 32 is somewhat alleviated by making top wall 18 slightly thinner adjacent access opening 32 as indicated by the numeral 39. Area 39 is joined with the remaining portion of wall 18 by a smooth ramped portion 41 that is configured to not tear the plastic that is typically wrapped around item 12.

Figure 4:
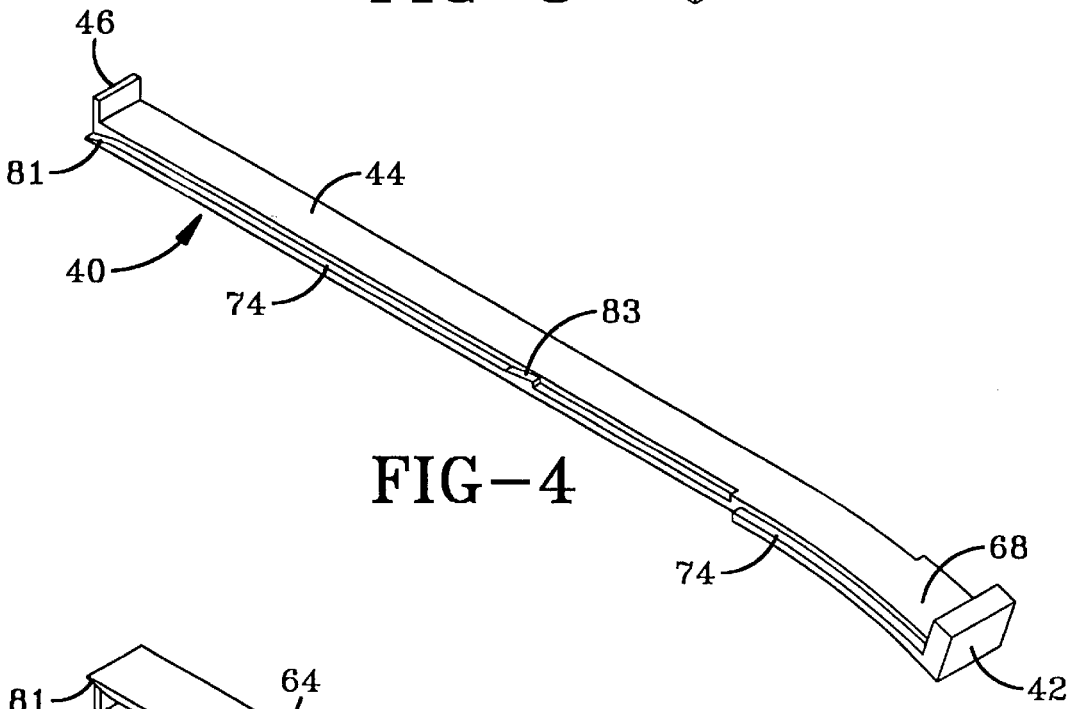
FIG. 4 is a perspective view of the slide.
Figure 5:
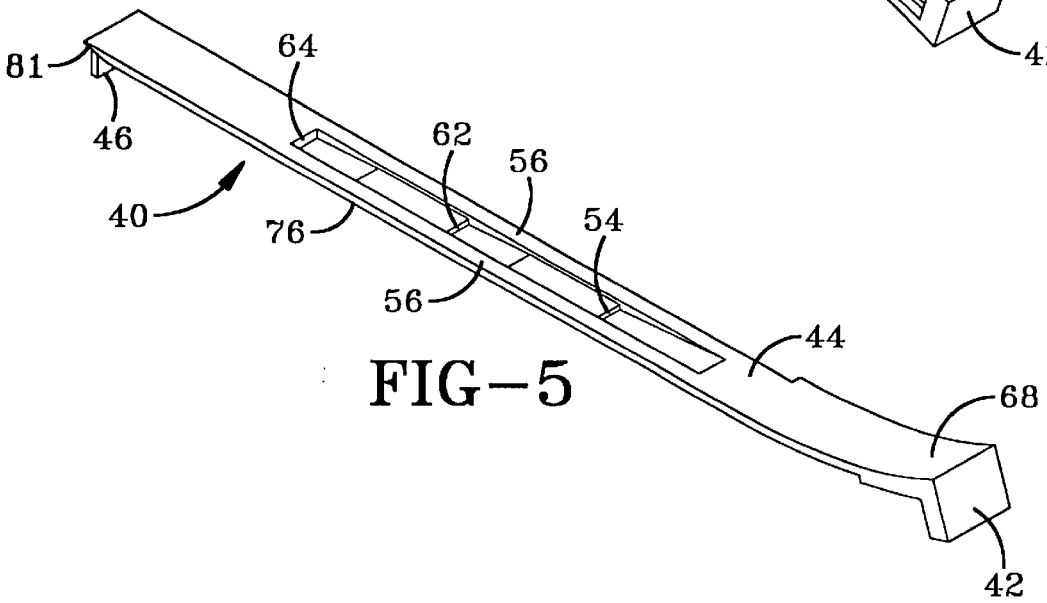
FIG. 5 is a perspective view of the slide showing the bottom surface that cooperates with the locking mechanism.
Figure 6:
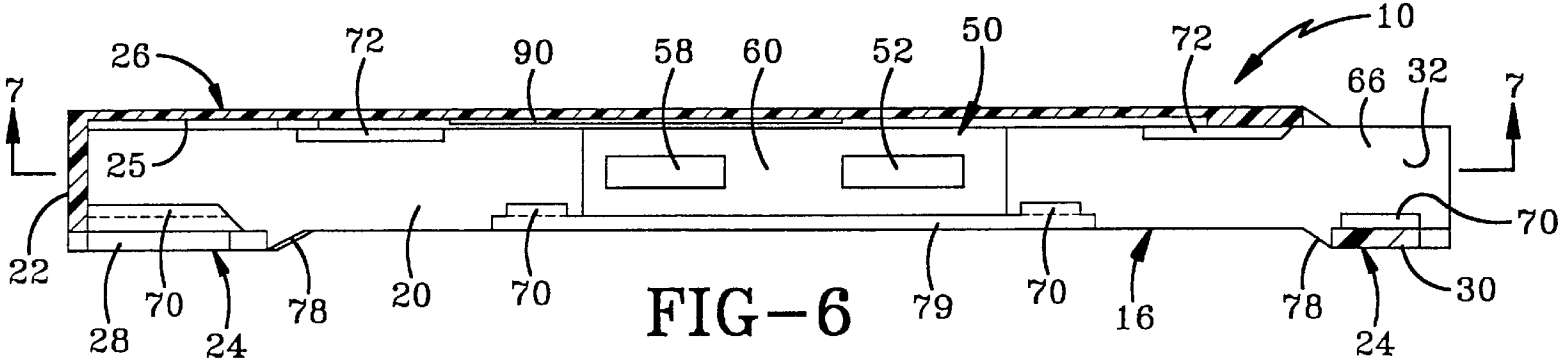
FIG. 6 is a top view of the bottom wall of the security storage container showing the lock mechanism and the slide retainers.
Figure 7:
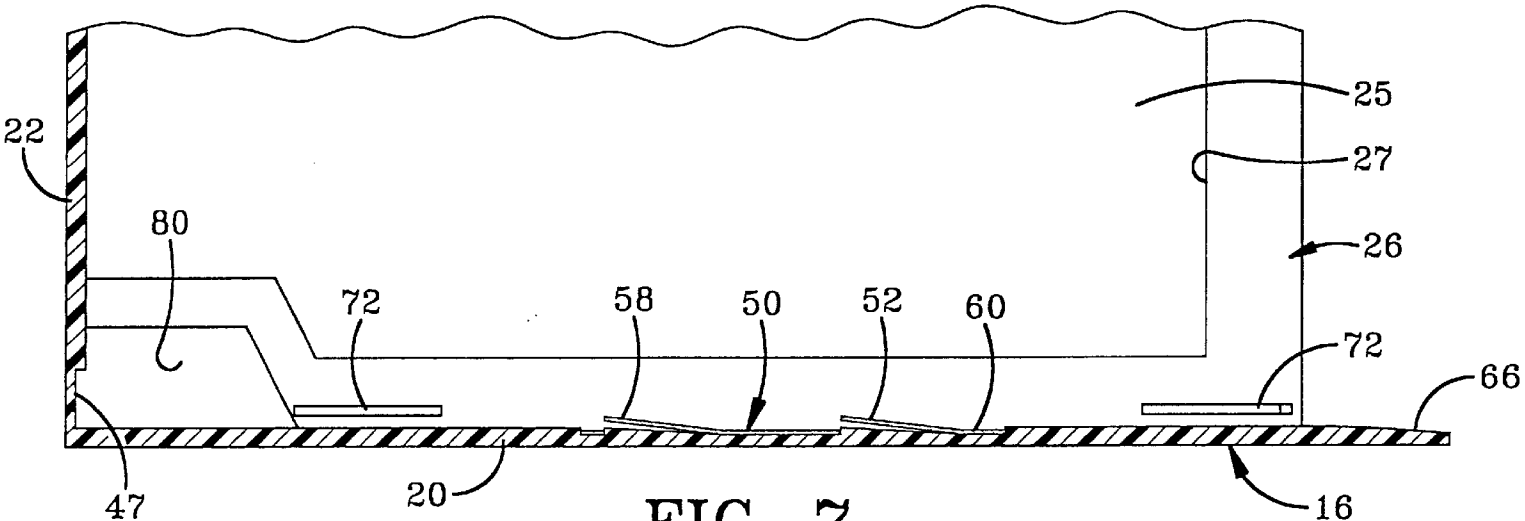
FIG. 7 is a sectional view taken along line 7—7 of FIG. 6.
Figure 9:
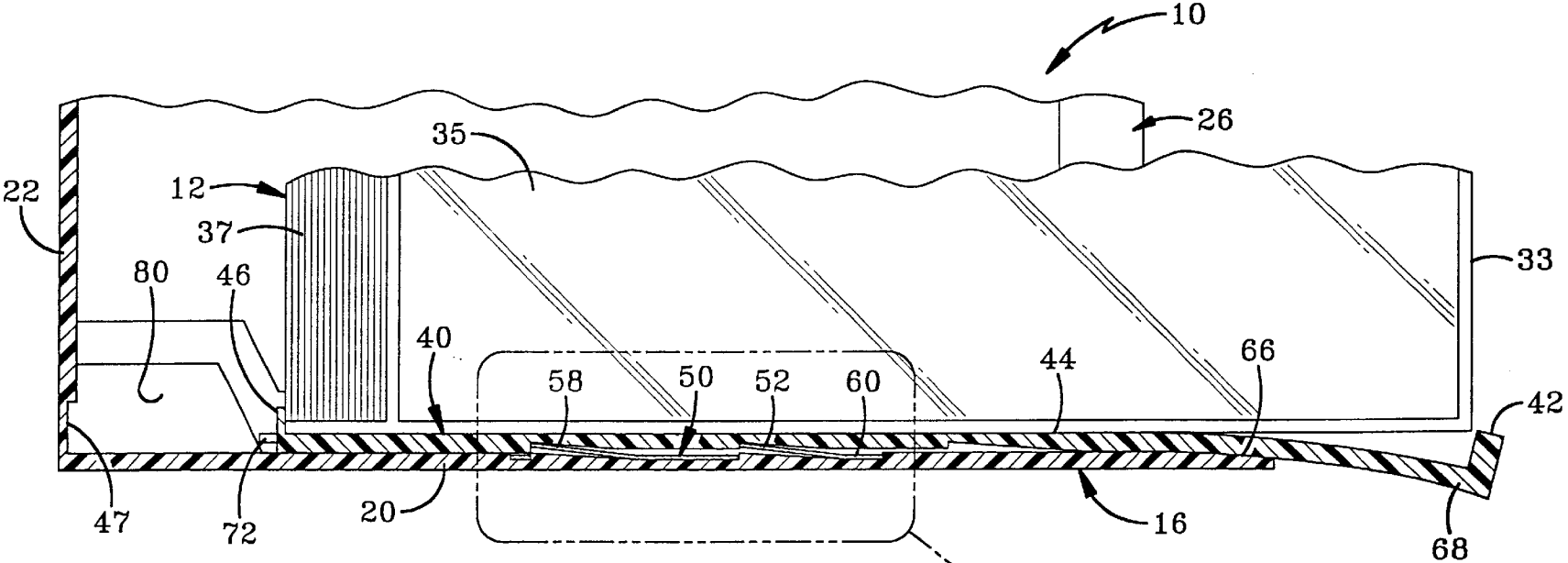
FIG. 9 is a sectional view taken along line 9—9 of FIG. 8.
Figure 10:
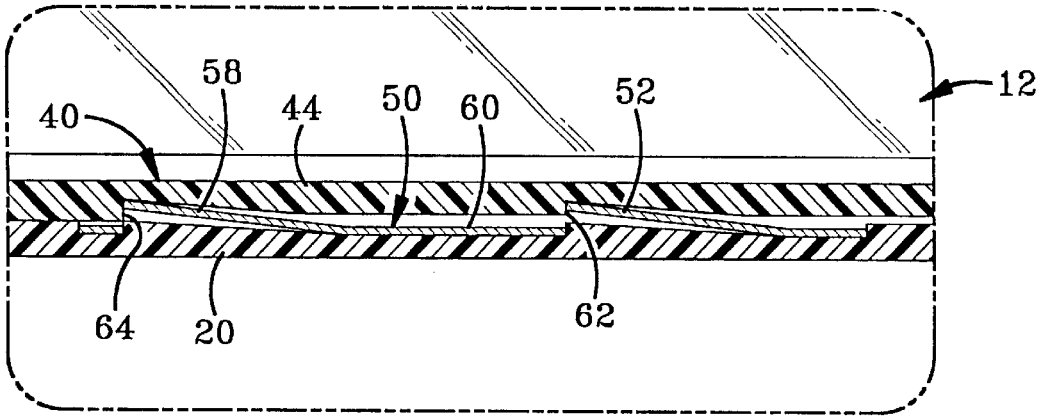
FIG. 10 is an enlarged view of the encircled portion of FIG. 9.
Figure 13:
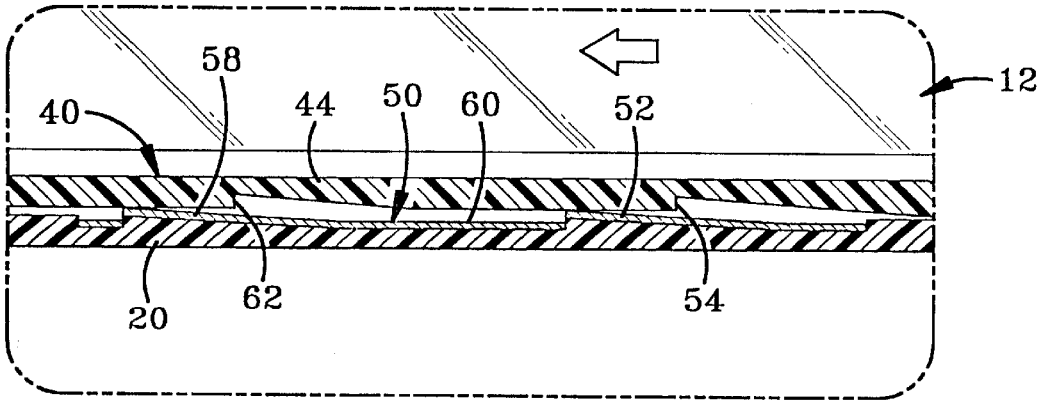
FIG. 13 is an enlarged view of the encircled portion of FIG. 12.
Figure 16:
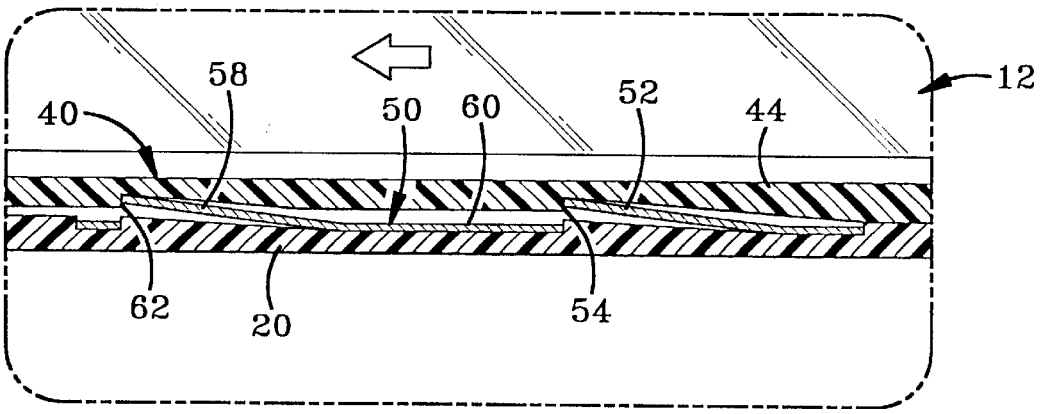
FIG. 16 is an enlarged view of the encircled portion of FIG. 15.
Figure 11:
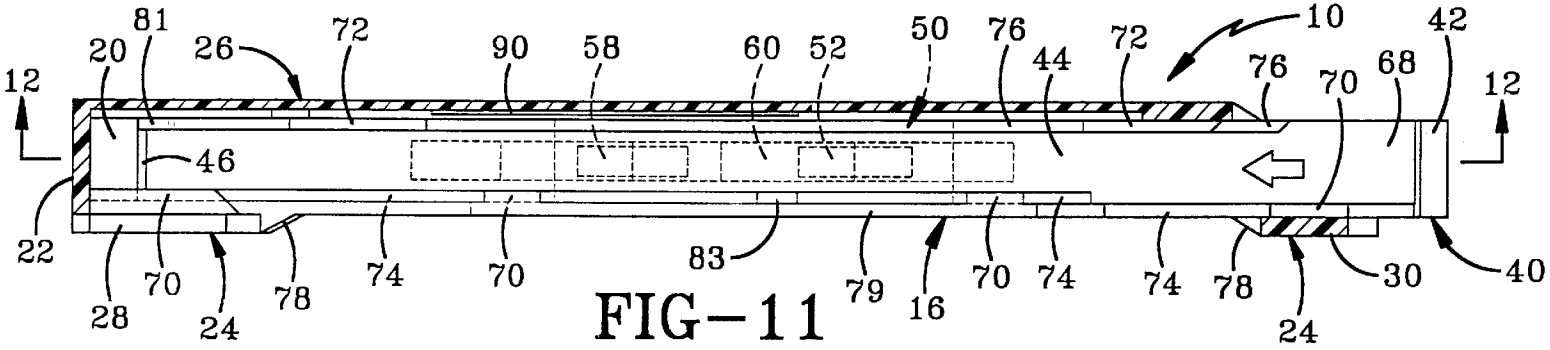
FIG. 11 is a view similar to FIG. 8 showing the slide being moved from the unlocked position to the locked position.
Figure 12:
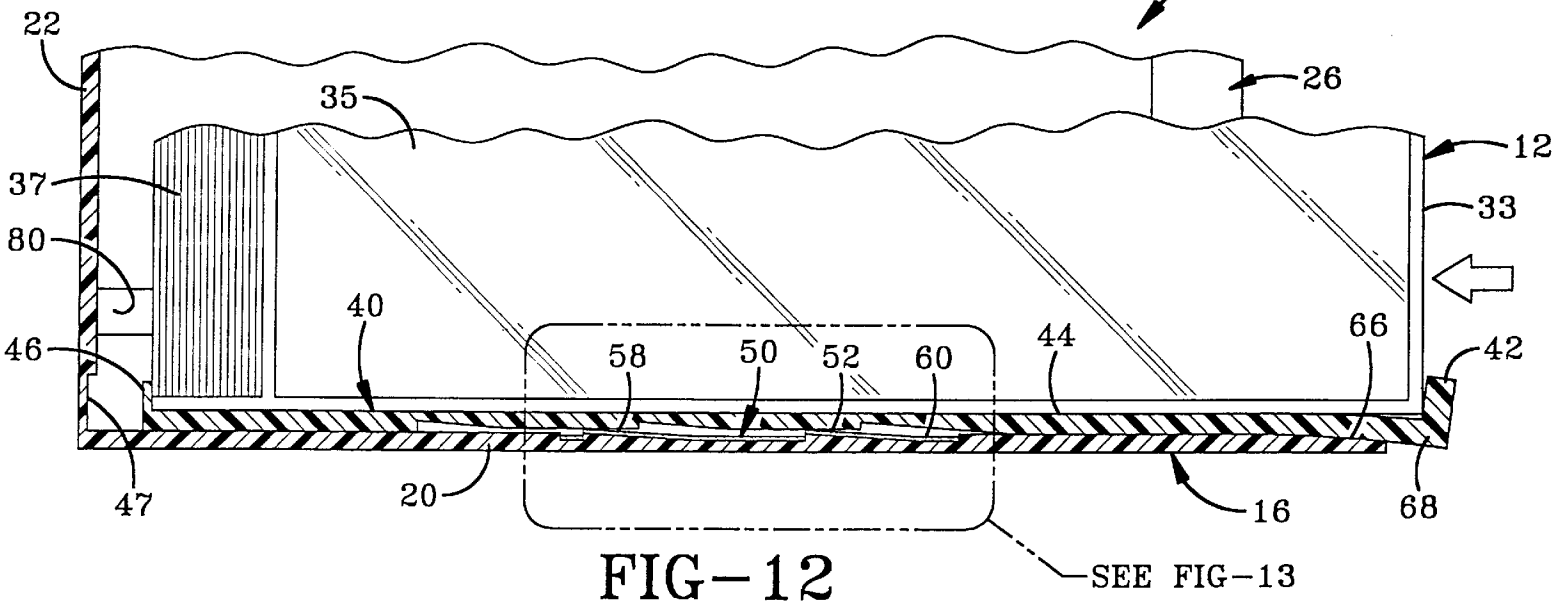
FIG. 12 is a sectional view taken along line 12—12 of FIG. 11.
Figure 14:
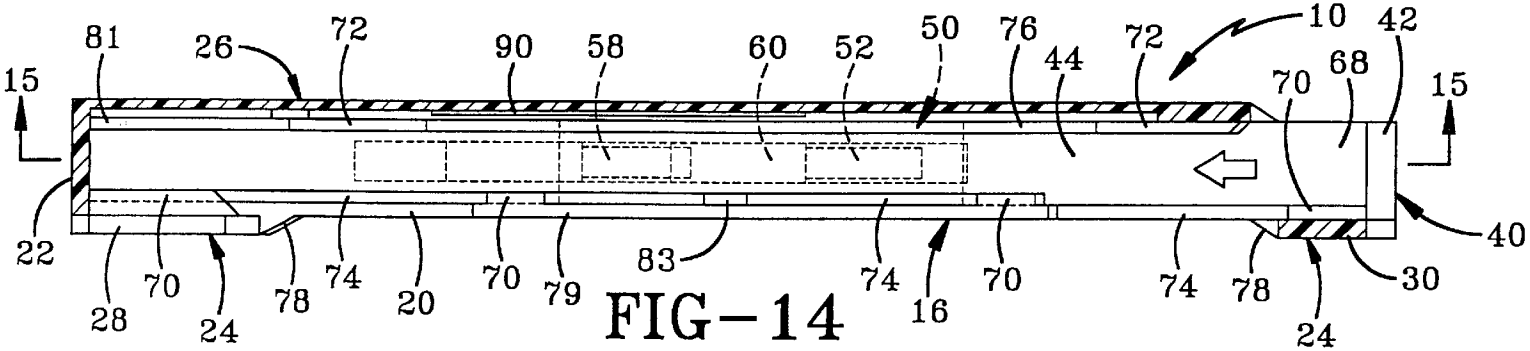
FIG. 14 is a view similar to FIG. 8 showing the slide in a locked position.
Figure 15:
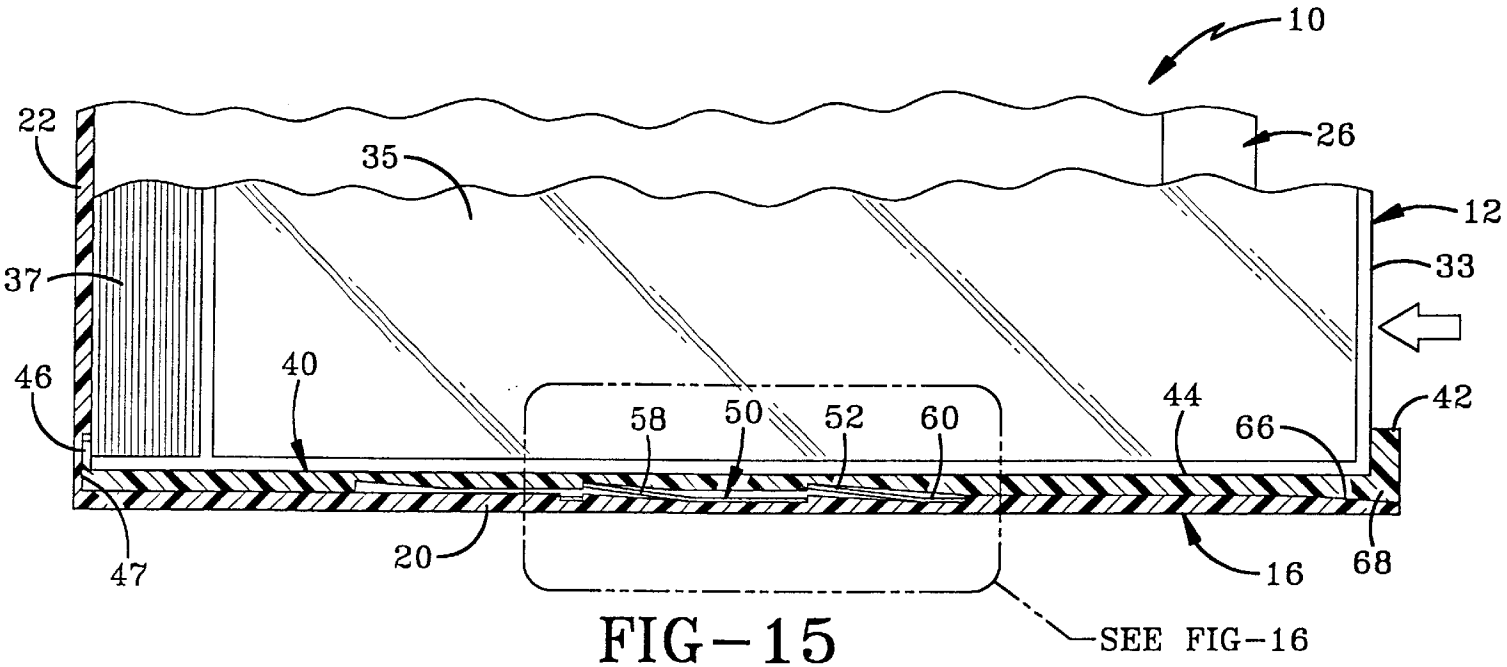
FIG. 15 is a sectional view taken along line 15—15 of FIG. 14.
Figure 17:
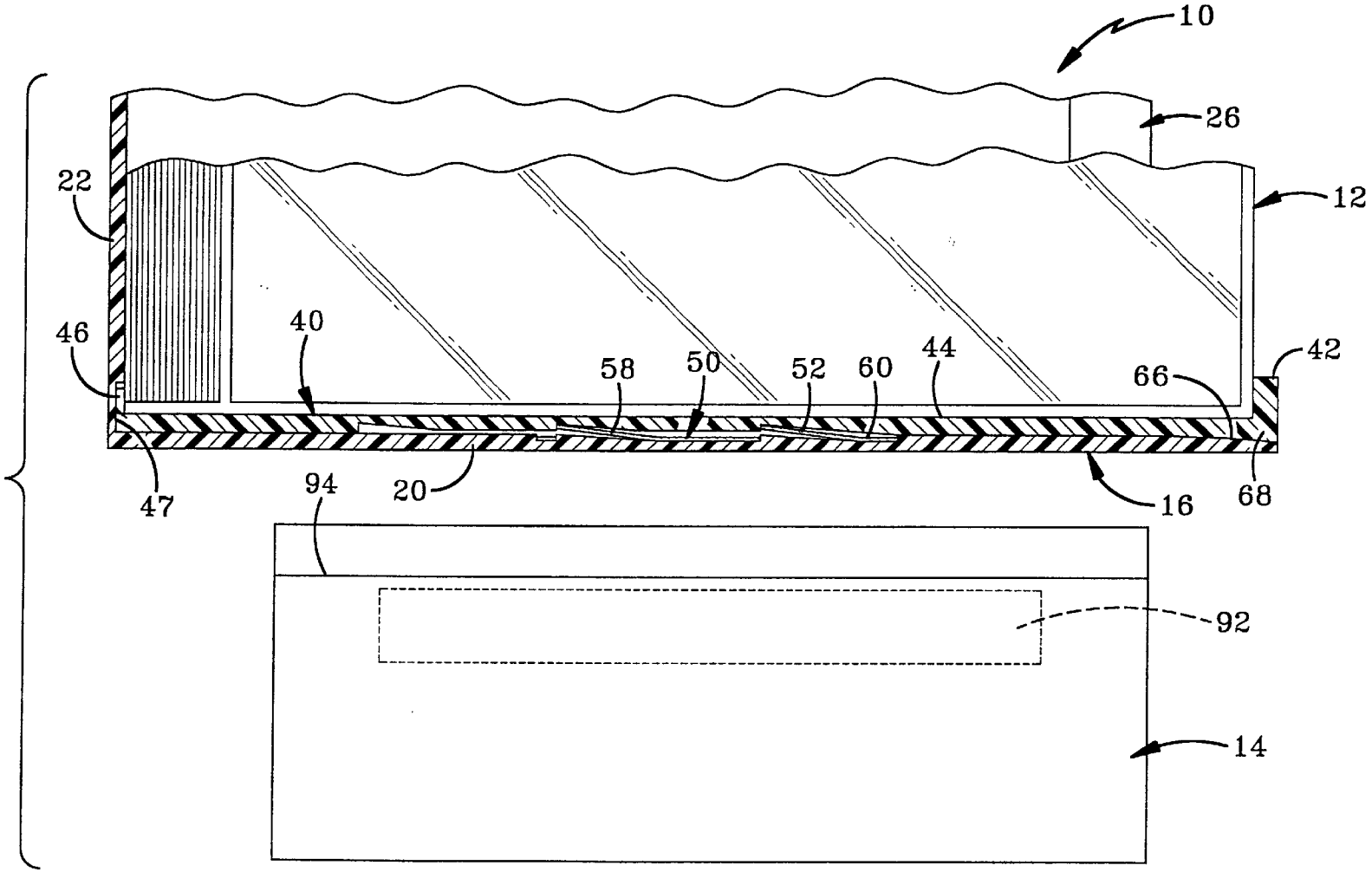
FIG. 17 is a side view, partially in section, of the security storage container being placed on a key to open the locking mechanism.
Figure 18:
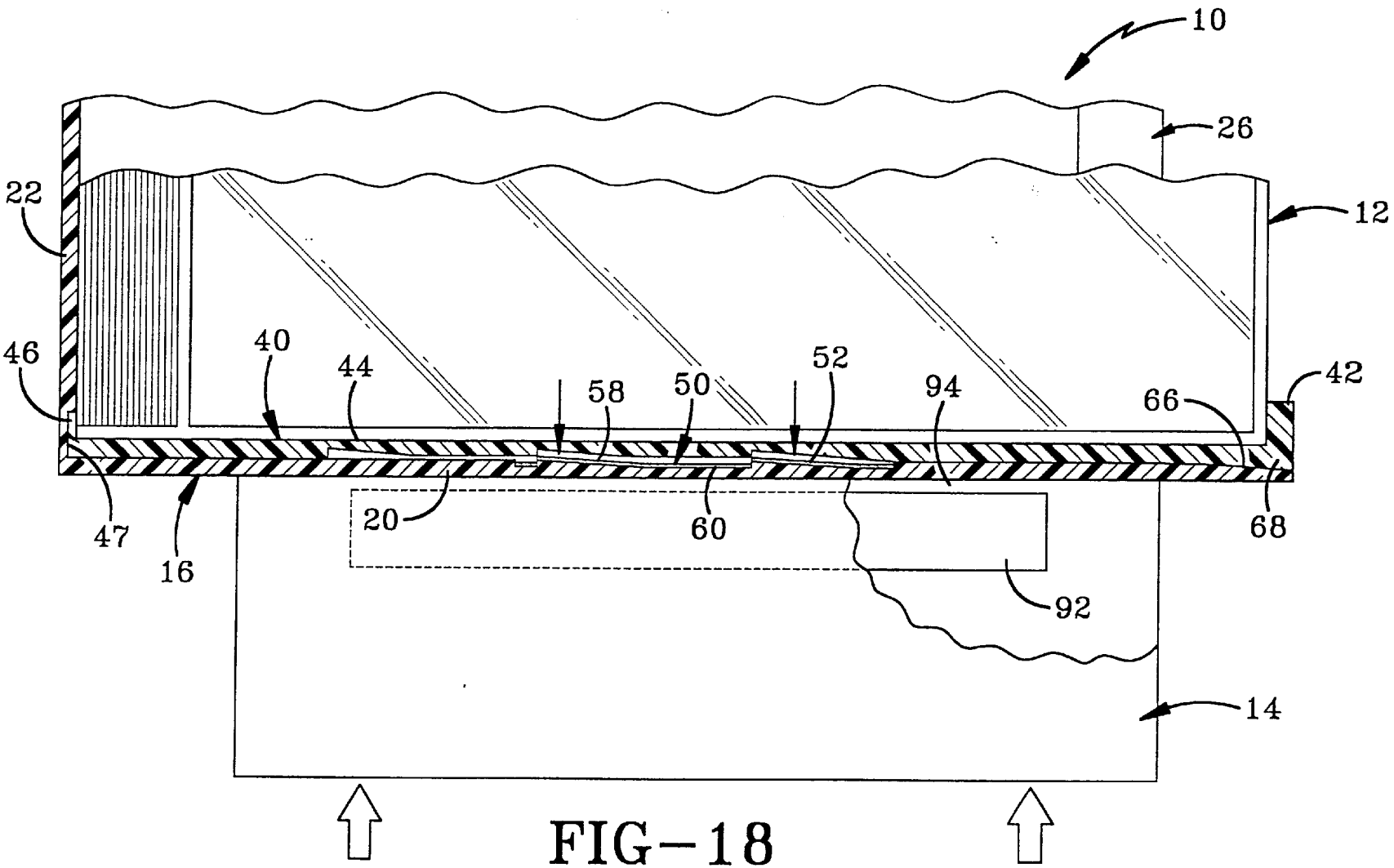
FIG. 18 is a view similar to FIG. 17 showing the key being used to unlock the locking mechanism.
Figure 19:
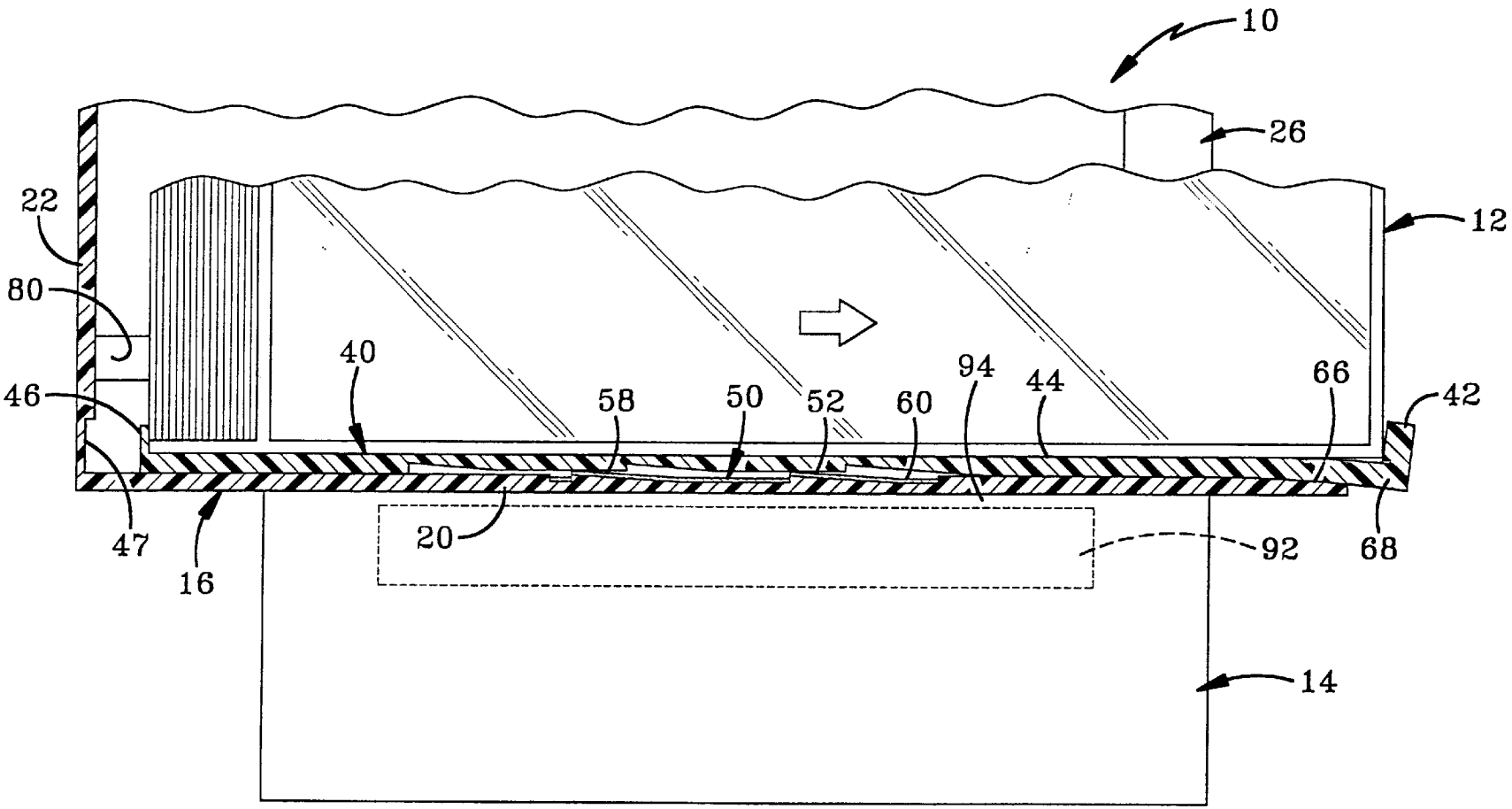
FIG. 19 is a view similar to FIG. 17 showing the slide being moved toward the unlocked position.
Figure 20:
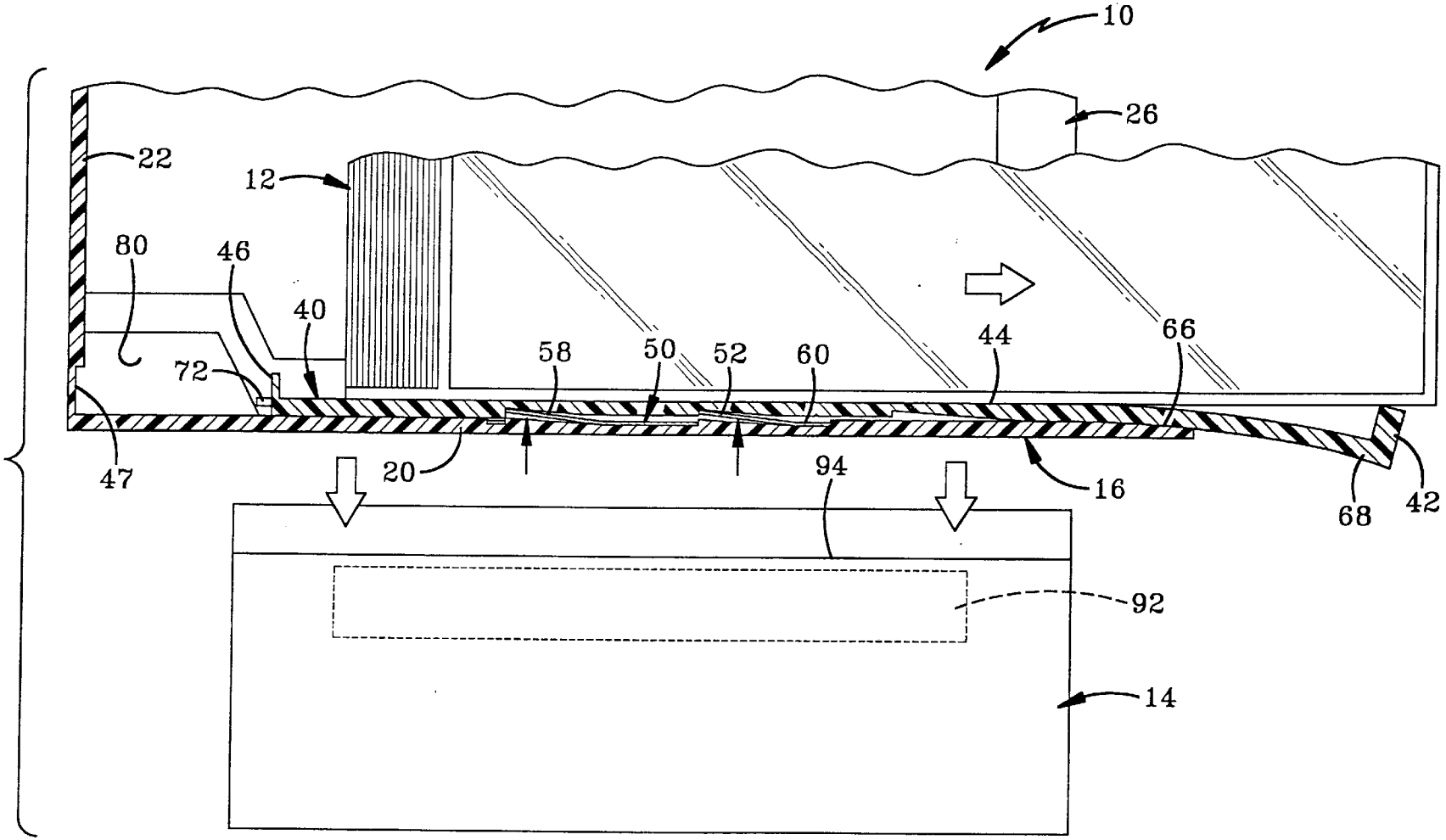
FIG. 20 is a view similar to FIG. 17 showing the slide moving out of the path of the item of recorded media in the unlocked position.

Slide 40 includes a lock tab 42 that extends at least partially across access opening 32 when slide 40 is in the locked position as depicted in FIG. 1. Lock tab 42 extends from a body 44 that is configured to bend out of the way of item 12 when slide 40 is moved to the unlocked position as depicted in FIG. 9. To achieve this objective of the invention, body 44 is formed with a curve at its outer end as depicted in FIGS. 4 and 5. Body 44 is fabricated from a material that is flexible enough to allow the curved end to straighten when slide 40 is moved to the locked position as depicted in FIGS. 12 and 15. When slide 40 is in the locked position as depicted in FIG. 15, body 44 functions as a loaded spring that relaxes when slide 40 is moved to the unlocked position. The spring action of body 44 automatically disengages lock tab 42 from item 12 as depicted in FIGS. 19 and 20. The automatic disengagement allows item 12 to be easily removed from security storage container 10 because the sales clerk needs only to place security storage container 10 on key 14 and pull item 12 out of security storage container 10. The removal of item 12 from container 10 is a single step process. In the preferred embodiment of the invention, slide 40 is fabricated from a fiber or glass-filled material such as vinyl, plastic, or another polymer so that it will be strong while remaining flexible through the life of container 10. In other embodiments, different materials may be used without departing from the concepts of the present invention although the materials must be able to be molded to fit the tolerances of container 10 while maintaining sufficient spring properties to provide the automatic disengagement with item 12.

Slide 40 further includes a rear tab 46 disposed on the opposite end of body 44 than lock tab 42. Rear tab 46 causes slide 40 to automatically move from the unlocked position to the locked position when item 12 is inserted into container 10. Rear tab 46 may abut the inner surface of rear wall 22 or may be disposed in a notch 47 formed in rear wall 22. Notch 47 allows item 12 to abut wall 22 when item 12 is inserted into container 10.

Security storage container 10 further includes a locking member 50 that holds slide 40 in the locked position with respect to frame 16. Locking member 50 includes at least one flexible locking finger 52 that locks slide 40 in the locked position when slide 40 is pushed entirely into frame 16. In this position, locking finger 52 engages a first locking ledge 54 formed in the bottom of slide 40. Locking finger 52 may be secured to wall 20 of frame 16 in any of a variety of known manners. Ledge 54 is preferably bounded on both sides by lateral locking walls 56 disposed longitudinally on both sides of ledge 54. Walls 56 prevent locking finger 52 from moving laterally out of slide 40 when locking finger is in the locked position.

In the preferred embodiment of the invention, locking member 50 includes first locking finger 52 and a second locking finger 58 extending up from a lock frame 60. Lock frame 60 is preferably formed from spring steel with fingers 52 and 58 punched and formed directly from frame 60. Second locking finger 58 engages a second locking ledge 62 formed in slide 40 when slide 40 is in the locked position. Second locking ledge 62 is also disposed between walls 56 to prevent finger 58 from moving laterally. Second locking finger 58 provides additional security to container 10 and helps foil shoplifters who attempt to pick container 10.

Slide 40 includes a third locking ledge 64 disposed between second locking ledge 62 and rear tab 46. Third locking ledge 64 prevents slide 40 from being pulled out of frame 16 when item 12 is being removed from container 10. Ledges 62 and 64 as well as fingers 52 and 58 are spaced to allow slide 40 to move to the unlocked and open position with lock tab 42 out of the way of item 12 when fingers 52 and 58 engage ledges 62 and 64 to stop the outward movement of slide 40.

The front portion of bottom wall 20 is preferably curved downwardly as indicated by the numeral 66 to help slide 40 move downwardly when it moves to the unlocked and open position. Slide 40 includes a corresponding end portion 68 having a tapered thickness so that the bottom surface of slide 40 stays in contact with the upper surface of bottom wall 20 while slide 40 is disposed in frame 16.

Slide 40 is retained in frame 16 by front 70 and rear 72 retaining members that extend over front 74 and rear 76 ledges formed in slide 40. Rear retaining members 72 project forwardly from back wall 26. Front retaining members 70 extend upwardly and rearwardly from bottom wall 20. Another front retaining member 70 extends rearwardly from front flange 30. A further front retaining member 70 extends rearwardly from lower corner flange 28. In the preferred embodiment of the invention, four front retaining members 70 and two rear retaining members 72 are used to form a slide cannel that slidably receives slide 40. Ledges 74 and 76 allow members 70 and 72 to securely retain slide 40 without extending above the upper surface of slide 40.

The bottom portion of back wall 26 (referenced by numeral 77) and the vertical portion of retaining members 70 (referenced by numeral 79) are free of openings that would allow a shoplifter to tamper with locking member 50. Portions 77 and 79 are solid, continuous walls that block all access to locking member 50 through the sides of container 10.

Figure 8:
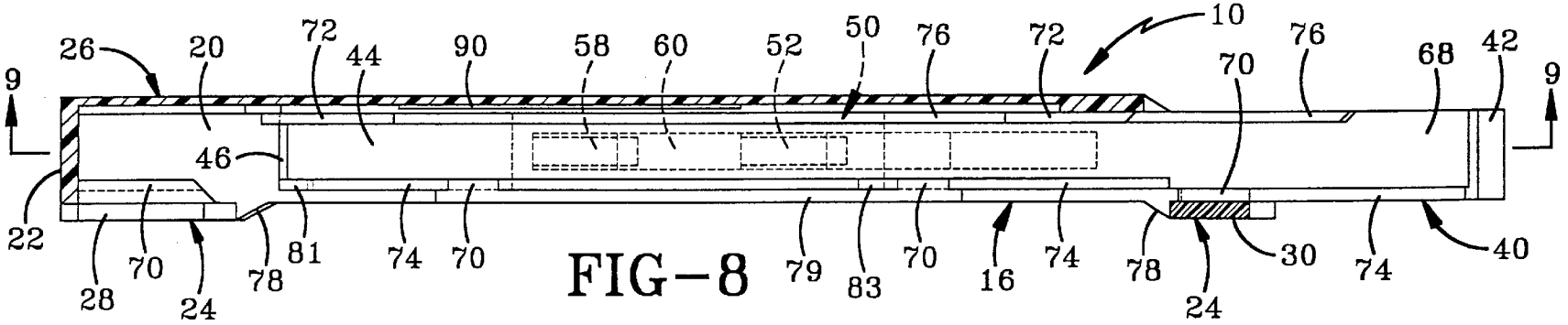
FIG. 8 is a view similar to FIG. 6 with the slide in place.

Slide 40 further includes a rear ramp 81 that facilitates the installation of slide 40 into frame 16. Rear ramp 81 is formed along ledge 74 as shown in FIG. 4. Slide 40 further includes a locking stop 83 that projects upwardly from ledge 74. Locking stop 83 is positioned along slide 40 such that it engages one of retaining members 70 when slide 40 is in the unlocked and open position as depicted in FIG. 8. Stop 83 works in cooperation with the engagement of locking fingers 52 and 58 to prevent slide 40 from being removed from frame 16. Stop 83 is ramped allowing it to be inserted into frame 16.

Figure 21:
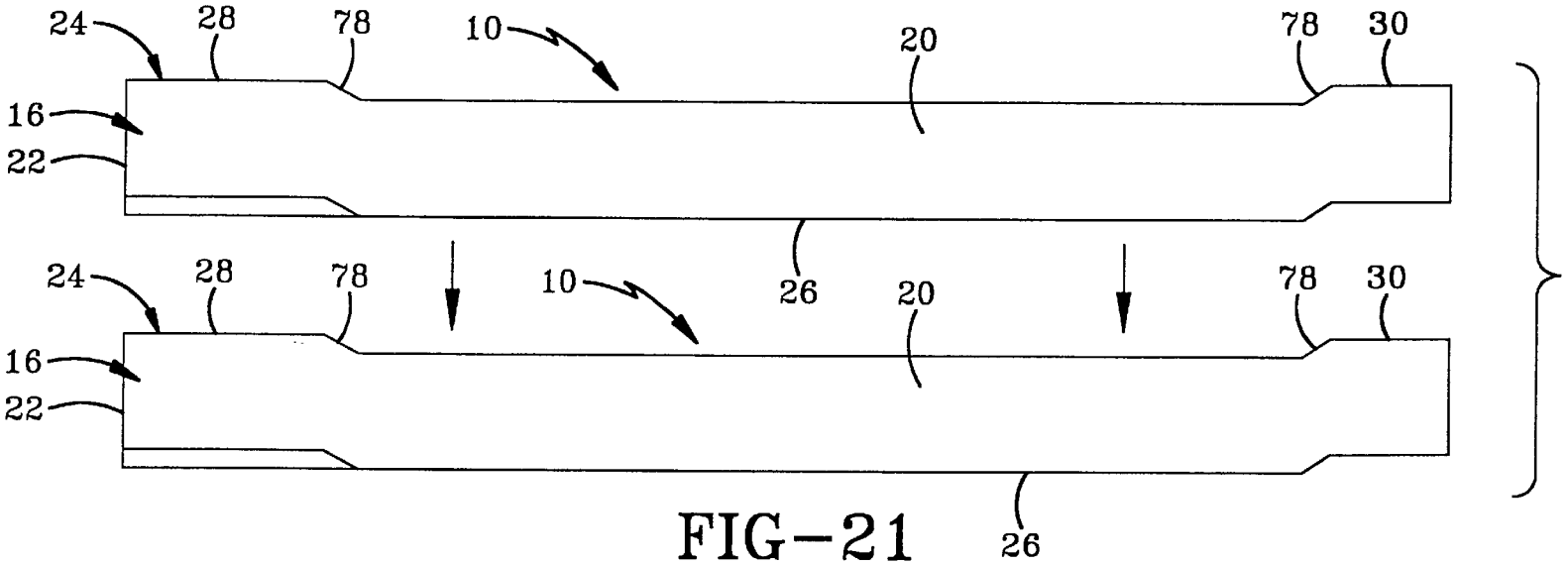
FIG. 21 is a side view of two security storage containers being placed together for display or storage.
Figure 22:
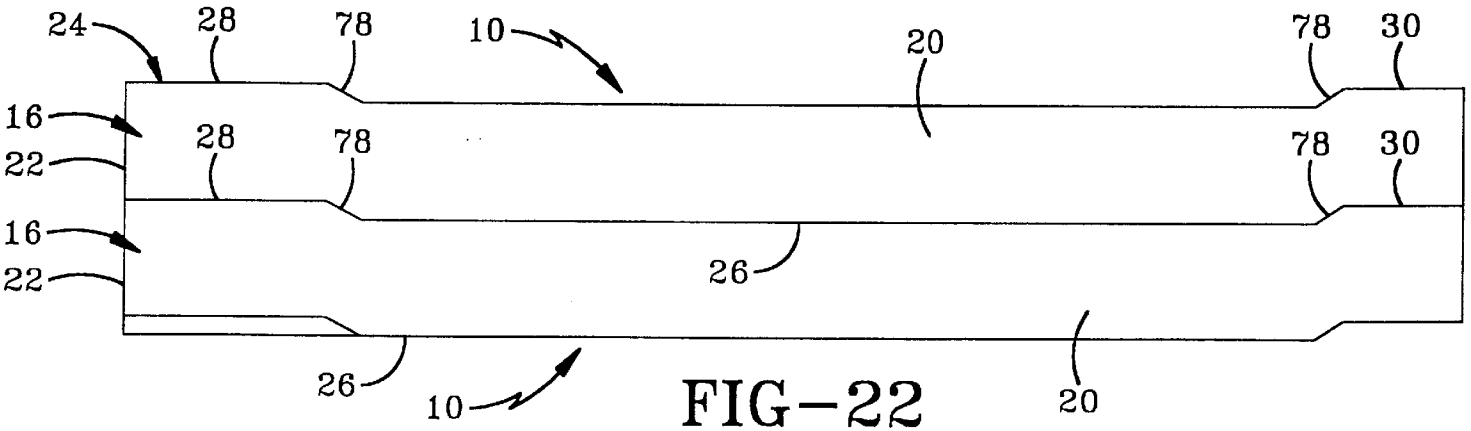
FIG. 22 is a side view of two security storage containers being nested together.

Corner flanges 28 and front flange 30 are spaced apart far enough to allow back wall 26 to nest between flanges 28 and flange 30 as shown in FIGS. 21 and 22. Each flange 28 and 30 preferably includes an angled inner surface that allows containers 10 to be slid apart without catching on one another. Back wall 26 includes corner openings 80 that receive corner flanges 28 when containers 10 are nested together. Back wall 26 is also sized to allow front flange 30 to nest with back wall 26. The nesting configuration saves shelf and storage space when multiple containers 10 are stacked together.

Front flange 30 has a wider base 82 that covers lock tab 42 when slide 40 is in the locked position. Base 82 prevents a shoplifter from prying at lock tab 42 from the side with a pry bar. Base 82 is also angled to prevent a shoplifter from striking base 82 on the edge of a display case in order to break lock tab 42. Top wall 18 includes an angled end 84 that allows the user of container 10 to pull the top corner of item 12 when removing item 12 from container 10.

In accordance with another objective of the present invention, back wall 26 is substantially uninterrupted to allow information on the rear of item 12 to be easily scanned by scanning devices without being interrupted by an edge that distorts the scanning light beams. In addition, the existing corners are formed with sharp edges with a 0.010 radius to minimize distortion during scanning.

Container 10 is loaded by first moving slide 40 to the open and unlocked position as depicted in FIGS. 8 and 9. An item of recorded media 12 may then be slid into container 10 until item 12 engages rear tab 46. As shown in FIG. 9, tab 42 is moved down out of the slide path so that tab 42 does not interfere with the loading of container 10. FIG. 9 depicts how the upper edge of tab 42 is disposed below the upper surface of the portion of slide 40 that remains inside frame 16. The upper edge of tab 42 is thus disposed below the lower surface of item 12 so that item 12 may slide directly out of frame 16 with tilting item 12.

Item 12 is then pushed farther into container 10 moving slide 40 with it. Tab 42 automatically moves into its locked position as shown in FIG. 12. Item 12 is pushed into container 10 until locking member 50 engages slide 40 to lock it inside frame 16. Item 12 is then securely locked with within container 10. An EAS tag 90 (FIG. 15) may be fastened to one of item 12 and container 10 in a location where EAS tag 90 may not be removed when item 12 is locked in container 10. Container 10 and item 12 are thus secure unless a shoplifter can break frame 16.

Item 12 is removed from container 10 using key 14. Key 14 includes at least one appropriate magnet 92. In other embodiments, key 14 may include a magnet 92 for each locking finger 52 and 58. Magnets 92 are preferably disposed under a wall 94 on key 14 so that a shoplifter cannot easily ascertain the position and shape of magnet 92.

Bottom wall 20 is brought into contact with wall 94 so that magnet 92 is aligned with and attracts locking fingers 52 and 58. The magnet attraction moves fingers 52 and 58 from the locked position depicted in FIG. 17 to the unlocked position depicted in FIG. 18. The user then moves item 12 outwardly as shown in FIG. 19. Lock tab 42 eventually disengages item 12 as shown in FIG. 20 allowing the user to completely remove item 12 from container 10. FIG. 20 also shows that locking fingers 52 and 58 will snap into slide 40 to prevent it from being removed with item 12.

The second embodiment of the security storage container or keeper of the present invention is indicated generally by the numeral 200 in FIGS. 23 and 24. Security storage container 200 functions similarly to security storage container 10 described above and includes essentially all of the same structural elements as security storage container 10. As such, the same reference numerals are used to indicate the structural elements even though the front 24 and back 26 walls are reversed allowing security storage container 200 to be used in a "spine-out" configuration. In security storage container 200, front 35 of item 12 may be viewed through the large opening of front wall 24 that is disposed to the right of access opening 32. This configuration allows the hinge or spine 37 of item 12 to be disposed in access opening 32 with the end opening 33 of item 12 safely positioned adjacent wall 22. This configuration frustrates shoplifters while allowing front 35 to be clearly viewed by the customer. The configuration also allows the information along the spine of item 12 to be read through access opening 32.

Accordingly, the improved security storage container apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the security storage container is constructed and used, the characteristics of the construction, and the advantageous new and useful results obtained; the new and useful structures, devices, elements, arrangements, parts, and combinations are set forth in the appended claims.

What is claimed is:

1. A security device for displaying an item of merchandise; the security device securely holding an EAS tag with the item of merchandise so that the item of merchandise cannot be removed from the EAS tag without breaking an element of the security device unless a specially designed key is used to open the security device; the item of merchandise having at least one side; the security device comprising:

a frame adapted to receive and at least partially surround the item of merchandise;

the frame defining a storage compartment and an access opening through which the item of merchandise may be loaded into the storage compartment and unloaded from the storage compartment;

a slide carried inside the storage compartment;

the slide movable between locked and unlocked positions;

the slide having an inner end and an outer end and a longitudinal dimension extending between the inner and outer ends;

a lock tab connected to the outer end of the slide;

the lock tab blocking a portion of the access opening when the slide is in the locked position such that the lock tab is adapted to prevent the merchandise from being unloaded from the storage compartment when the slide is in the locked position;

a locking mechanism disposed between the slide and the frame;

the locking mechanism includes two resilient locking fingers that extend up from a common lock frame; each locking finger being a thin resilient metal tab; the common lock frame being a thin metal frame; the locking fingers being punched from the common lock frame;

the locking fingers being configured to move between locked and unlocked positions wherein the locking fingers engage the slide at spaced locations when the locking fingers are in the locked position;

wherein the slide defines two locking ledges each bounding a side of a pair of respective depressions formed in the slide; the locking fingers engaging the locking ledges when the slide is in the locked position; and wherein the slide further defines a pair of lateral locking walls disposed adjacent the locking ledges to prevent the locking fingers from moving laterally with respect to the longitudinal dimension of the slide when the locking fingers are engaged with the locking ledges.

2. The security device of claim 1, wherein the frame includes a bottom wall; the slide being disposed adjacent the bottom wall; the bottom wall having a front portion adjacent the access opening; the front portion of the bottom wall being curved downwardly away from the access opening.

3. The security device of claim 2, wherein the outer end of the slide is curved so that the lock tab moves down away from the storage compartment when the slide is moved to the unlocked position; the lock tab including an upper edge; the slide being sufficiently curved to move the upper edge of the lock tab below the upper edge of the portion of the slide that remains within the frame such that the item of merchandise may be easily removed from the frame.

4. The security device of claim 3, wherein the curved outer end of the slide is straightened when the slide is in the locked position.

5. The security device of claim 4, further comprising a rear tab connected to the inner end of the slide; the rear tab adapted to be engaged by the item of merchandise when the item of merchandise is inserted into the storage compartment to move the slide from the unlocked position to the locked position.

6. The security device of claim 2 herein the bottom wall has an upper surface and a lower surface; the lower surface of the front portion of the bottom wall being substantially flat and the upper surface of the front portion of the bottom wall being curved downwardly away from the access opening.

7. The security device of claim 2 wherein the slide has a tapered end portion corresponding to the curved front portion of the bottom wall so that the bottom surface of the slide is in contact with the upper surface of the bottom wall when the slide is in the locked position.

8. The security device of claim 1, wherein at least one of the locking fingers engages the slide to prevent the slide from sliding out of the frame.

9. The security device of claim 8, wherein the frame includes a retaining member that engages the slide to retain the slide on the frame; the slide including a stop that is positioned to engage the retaining member to help prevent the slide from sliding out of the frame.

10. The security device of claim 1, wherein the frame includes a top wall having a middle portion having a thickness and a front end adjacent the access opening; the front end of the top wall having a thickness less than the thickness of the middle portion such that an item of merchandise may be more easily loaded into the storage compartment.

11. The security device of claim 10, wherein the top wall defines a smooth ramped portion disposed between the front end of the top wall and the middle portion of the top wall.

12. The security device of claim 1, wherein the frame includes:

a back wall and a front wall disposed opposite the back wall;

the front wall defining a viewing opening that allows the consumer to directly view one of the at least one side of the item of merchandise without looking through a wall of the frame;

the viewing opening exposing substantially all of the one of the at least one side of the merchandise;

the viewing opening being positioned to the right of the access opening and the back wall being disposed to the left of the access opening such that a hinged item of merchandise may be displayed in a spine out configuration with the front of the merchandise being viewed through the viewing opening.

13. The security device of claim 1 wherein each locking finger has an upper surface and the depressions each have a surface which is complementary to the respective upper surfaces of the locking fingers to prevent the locking fingers from bending during an attempt to move the slide out of the locked position.

14. A security device for displaying an item of merchandise; the security device securely holding an EAS tag with the item of merchandise so that the item of merchandise cannot be removed from the EAS tag without breaking an element of the security device unless a specially designed key is used to open the security device; the item of merchandise having at least one side; the security device comprising:

a frame adapted to receive and at least partially surround the item of merchandise;

the frame defining a storage compartment and an access opening through which the item of merchandise may be loaded into the storage compartment and unloaded from the storage compartment;

a slide carried inside the storage compartment;

the slide having a body which abuts the item of merchandise when the item of merchandise is disposed in the storage compartment;

the slide movable between locked and unlocked positions;

the slide having an inner end and an outer end and a longitudinal dimension extending between the inner and outer ends;

a lock tab connected to the outer end of the slide;

the lock tab blocking a portion of the access opening when the slide is in the locked position such that the lock tab is adapted to prevent the merchandise from being unloaded from the storage compartment when the slide is in the locked position;

the outer end of the slide being curved so that the lock tab moves down away from the storage compartment when the slide is moved to the unlocked position; the lock tab including an upper edge;

the slide being sufficiently curved to move the upper edge of the lock tab below the upper edge of the portion of the slide that remains within the frame such that the item of merchandise may be easily removed from the frame; and a locking mechanism disposed between the slide and the frame.

15. The security device of claim 14 wherein the slide body has an upper surface and includes front and rear ledges and the frame includes front and rear retaining members that extend respectively over the front and rear ledges without extending above the upper surface of the slide body.

* * * * *